US007938268B1

(12) United States Patent
Kuo

(10) Patent No.: US 7,938,268 B1
(45) Date of Patent: May 10, 2011

(54) COSMETIC BOX FOR STORING MULTIPLE COSMETIC ITEMS

(75) Inventor: An-Kung Kuo, Changhua Hsien (TW)

(73) Assignee: Lo Mei Cosmetics Enterprise Co., Ltd., Changhua Hsien (TW)

( * ) Notice: Subject to any disclaimer, the term of this patent is extended or adjusted under 35 U.S.C. 154(b) by 356 days.

(21) Appl. No.: 12/053,150

(22) Filed: Mar. 21, 2008

(51) Int. Cl.
*B65D 69/00* (2006.01)

(52) U.S. Cl. ..... 206/581; 132/294; 132/314; 132/297; 132/318

(58) Field of Classification Search ..... 206/581, 206/823; 132/294, 293, 297, 317, 314, 318, 132/310
See application file for complete search history.

(56) References Cited

U.S. PATENT DOCUMENTS 2,628,624 A * 2/1953 De Mario ..... 401/31
2,825,085 A * 3/1958 Ingraham ..... 401/19
3,320,962 A * 5/1967 Moriber et al. ..... 401/31
4,728,211 A * 3/1988 Ladd, Jr. ..... 401/123
4,875,591 A * 10/1989 Mikesell ..... 211/69.1
5,107,984 A * 4/1992 Welschoff ..... 206/751
6,702,112 B1 * 3/2004 Henderson ..... 206/350
6,886,695 B1 * 5/2005 Karoly ..... 206/581
6,895,628 B1 * 5/2005 Anderson ..... 15/106
7,287,923 B1 * 10/2007 Chen ..... 401/18

* cited by examiner

*Primary Examiner* — Mickey Yu
*Assistant Examiner* — Jenine M Pagan
(74) *Attorney, Agent, or Firm* — Alan Kamrath; Kamrath & Associates PA

(57) ABSTRACT

A cosmetic box includes a main body having a periphery provided with a plurality of receiving chambers, and a plurality of cosmetic items mounted in the receiving chambers of the main body respectively. Thus, the main body is provided with a plurality of receiving chambers to receive a plurality of cosmetic items to facilitate a user's makeup purposes. In addition, when each of the cosmetic items protrudes outwardly from the main body, the container of each of the cosmetic items is non-rotatable relative to the respective receiving chamber of the main body, so that the lid of each of the cosmetic items is rotatable relative to and detachable from the container to remove the brush from the container, thereby facilitating the user operating the brush.

12 Claims, 5 Drawing Sheets

COSMETIC BOX FOR STORING MULTIPLE COSMETIC ITEMS

BACKGROUND OF THE INVENTION

1. Field of the Invention

The present invention relates to a box and, more particularly, to a cosmetic box for storing cosmetics.

2. Description of the Related Art

A conventional cosmetic box (or case) comprises a main body to receive cosmetics, such as a lipstick, lip gloss, lip brush, lip liner and the like so as to provide a makeup function. However, the conventional cosmetic box can store a single piece of cosmetics only, so that a user has to prepare multiple cosmetic boxes to store multiple pieces of cosmetics so as to provide different makeup functions, thereby causing inconvenience to the user.

BRIEF SUMMARY OF THE INVENTION

In accordance with the present invention, there is provided a cosmetic box, comprising a main body having a periphery provided with a plurality of receiving chambers, and a plurality of cosmetic items mounted in the receiving chambers of the main body respectively.

The primary objective of the present invention is to provide a cosmetic box for storing multiple cosmetic items.

Another objective of the present invention is to provide a cosmetic box, wherein the main body is provided with a plurality of receiving chambers to receive a plurality of cosmetic items so that cosmetic box is used to store multiple cosmetic items to facilitate a user's makeup purposes.

A further objective of the present invention is to provide a cosmetic box, wherein when each of the cosmetic items protrudes outwardly from the main body, the container of each of the cosmetic items is locked in and non-rotatable relative to the respective receiving chamber of the main body, so that the lid of each of the cosmetic items is rotatable relative to and detachable from the container to remove the brush from the container, thereby facilitating the user operating the brush of each of the cosmetic items.

A further objective of the present invention is to provide a cosmetic box, wherein each of the cosmetic items is snapped into and locked in the respective receiving chamber of the main body when not in use, so that each of the cosmetic items is protected by the main body.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
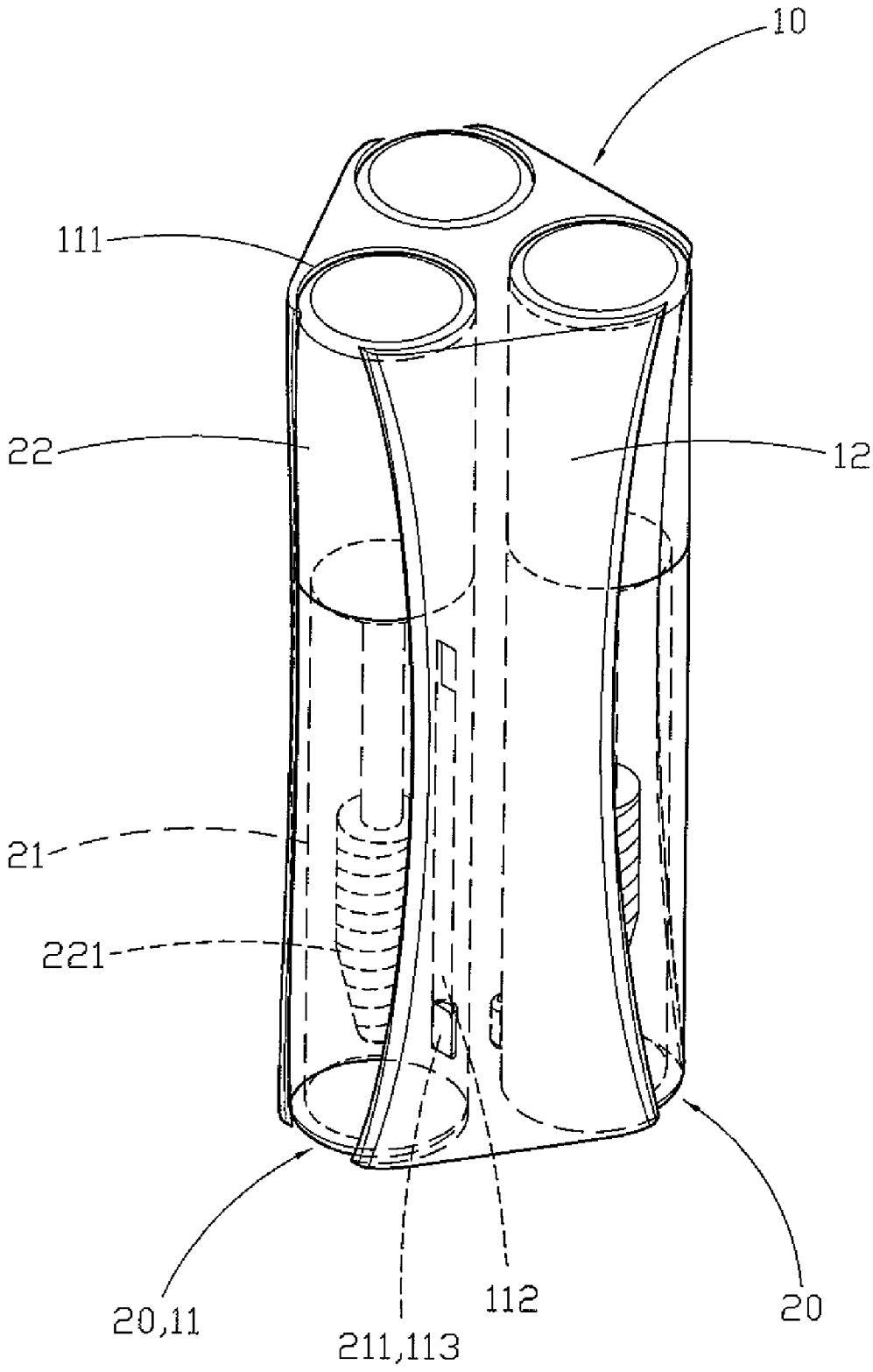
FIG. 1 is a perspective view of a cosmetic box in accordance with the preferred embodiment of the present invention.

Referring to the drawings and initially to FIGS. 1-4, a cosmetic box in accordance with the preferred embodiment of the present invention comprises a main body 10 having a periphery provided with a plurality of receiving chambers 11, and a plurality of cosmetic items 20 mounted in the receiving chambers 11 of the main body 10 respectively.

The main body 10 has a substantially rectangular cross-sectional profile. Each of the receiving chambers 11 of the main body 10 extends in a longitudinal direction of the main body 10 and extends through a whole length of the main body 10. Each of the receiving chambers 11 of the main body 10 is defined by a substantially C-shaped flexible limit wall 12 surrounding the respective cosmetic item 20 to clamp the respective cosmetic item 20 in an elastic manner. The limit wall 12 of each of the receiving chambers 11 of the main body 10 has an outer edge 120 having a substantially concave profile. Each of the receiving chambers 11 of the main body 10 has a first end provided with an opening 111 and a second end provided with a positioning groove 113. Each of the receiving chambers 11 of the main body 10 has a peripheral wall provided with an elongate guide slot 112 connected to the positioning groove 113. The guide slot 112 of each of the receiving chambers 11 of the main body 10 extends in the longitudinal direction of the main body 10 and has a first end connected to the positioning groove 113 and a second end provided with a limit portion 114 located between the opening 111 and the positioning groove 113.

Each of the cosmetic items 20 is movable in and non-rotatable relative to the respective receiving chamber 11 of the main body 10. Each of the cosmetic items 20 is provided with a positioning protrusion 211 movable in the guide slot 112 of the respective receiving chamber 11 of the main body 10 and detachably lockable in the positioning groove 113 of the respective receiving chamber 11 of the main body 10 so that each of the cosmetic items 20 is movable in and non-rotatable relative to the respective receiving chamber 11 of the main body 10.

Each of the cosmetic items 20 includes a container 21 and a lid 22 removably mounted on and rotatable relative to the container 21.

Figure 7:
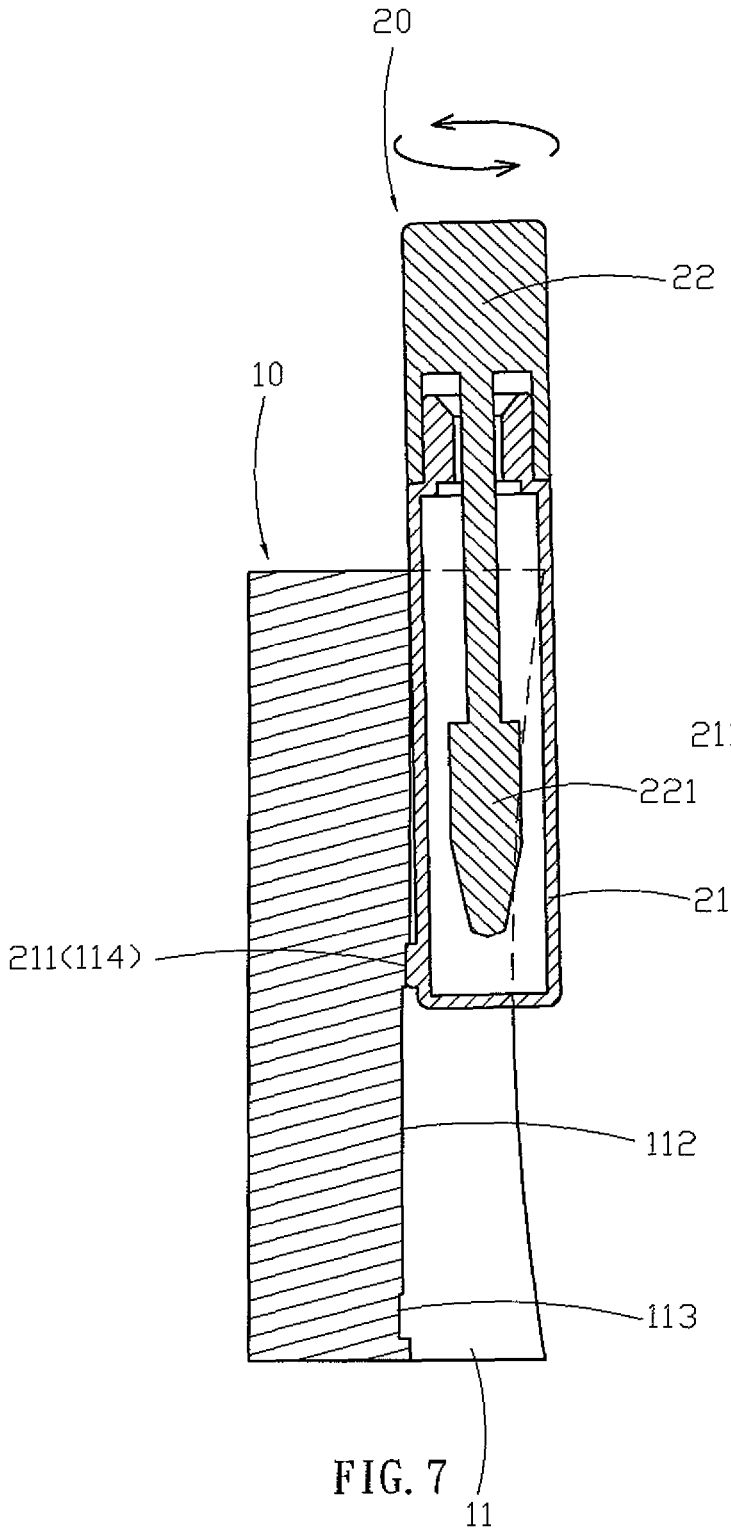
FIG. 7 is a schematic operational view of the cosmetic box as shown in FIG. 5.
Figure 8:
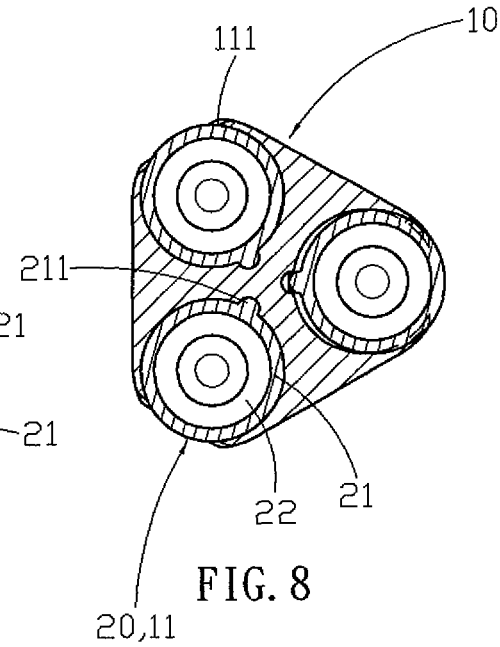
FIG. 8 is a top cross-sectional view of the cosmetic box as shown in FIG. 7.

The lid 22 of each of the cosmetic items 20 is located in the first end of the respective receiving chamber 11 of the main body 10 and provided with a brush 221 inserted into the container 21. The lid 22 of each of the cosmetic items 20 is fully hidden in the opening 111 of the respective receiving chamber 11 of the main body 10 when the positioning protrusion 211 of each of the cosmetic items 20 is locked in the positioning groove 113 of the respective receiving chamber 11 of the main body 10 as shown in FIGS. 3 and 4, and fully protrudes outwardly from the opening 111 of the respective receiving chamber 11 of the main body 10 when the positioning protrusion 211 of each of the cosmetic items 20 is movable to abut the limit portion 114 of the guide slot 112 of the respective receiving chamber 11 of the main body 10 as shown in FIGS. 7 and 8.

The container 21 of each of the cosmetic items 20 is located in the second end of the respective receiving chamber 11 of the main body 10 and has a periphery provided with the positioning protrusion 211. The container 21 of each of the cosmetic items 20 is fully hidden in the opening 111 of the respective receiving chamber 11 of the main body 10 when the positioning protrusion 211 of each of the cosmetic items 20 is locked in the positioning groove 113 of the respective receiving chamber 11 of the main body 10 as shown in FIGS. 3 and 4, and partially protrudes outwardly from the opening 111 of the respective receiving chamber 11 of the main body 10 when the positioning protrusion 211 of each of the cosmetic items 20 is movable to abut the limit portion 114 of the guide slot 112 of the respective receiving chamber 11 of the main body 10 as shown in FIGS. 7 and 8. The container 21 of each of the cosmetic items 20 is locked in and non-rotatable relative to the respective receiving chamber 11 of the main body 10 when the positioning protrusion 211 of each of the cosmetic items 20 is limited in the limit portion 114 of the guide slot 112 of the respective receiving chamber 11 of the main body 10.

Figure 2:
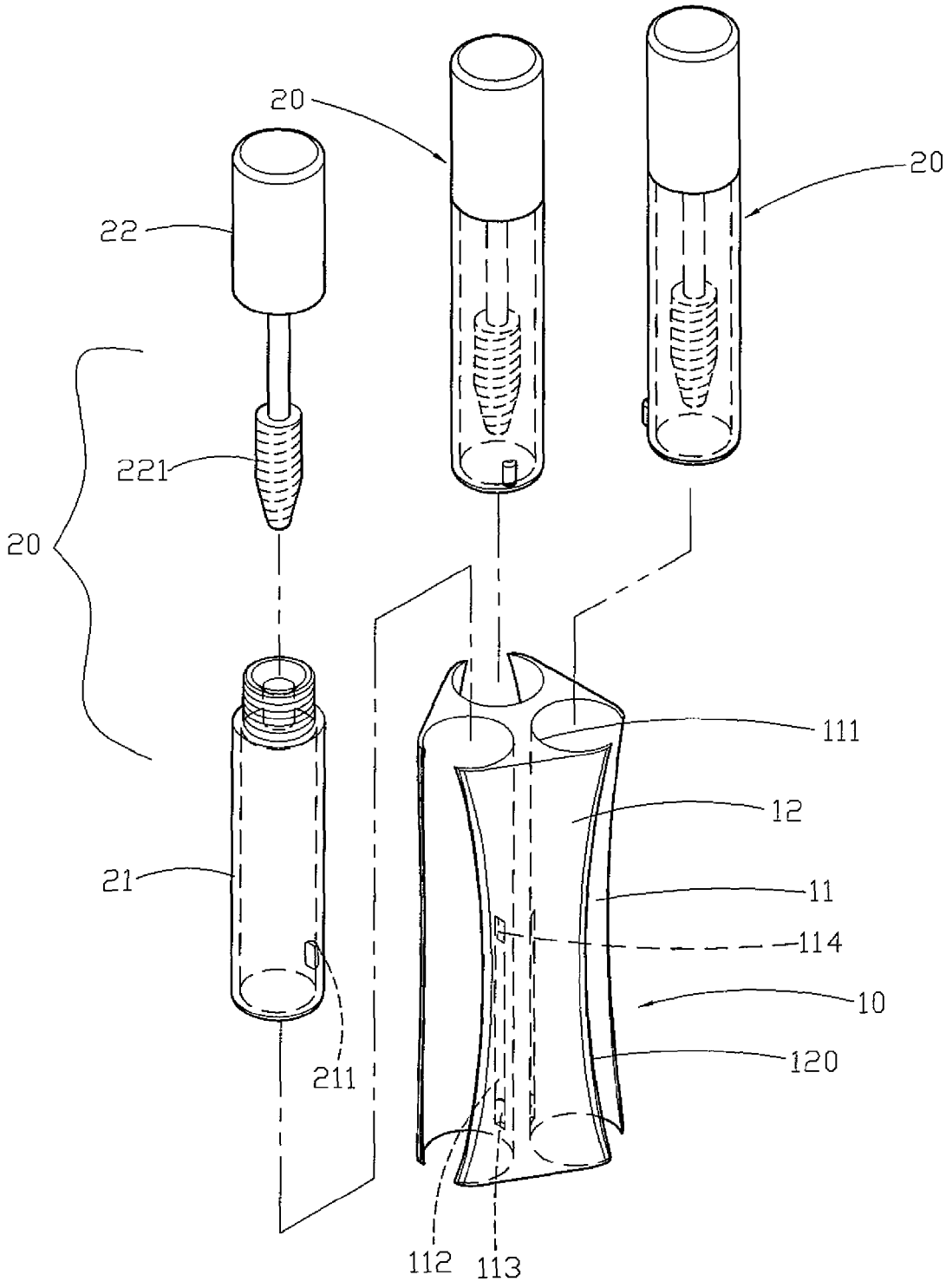
FIG. 2 is an exploded perspective view of the cosmetic box as shown in FIG. 1.
Figure 3:
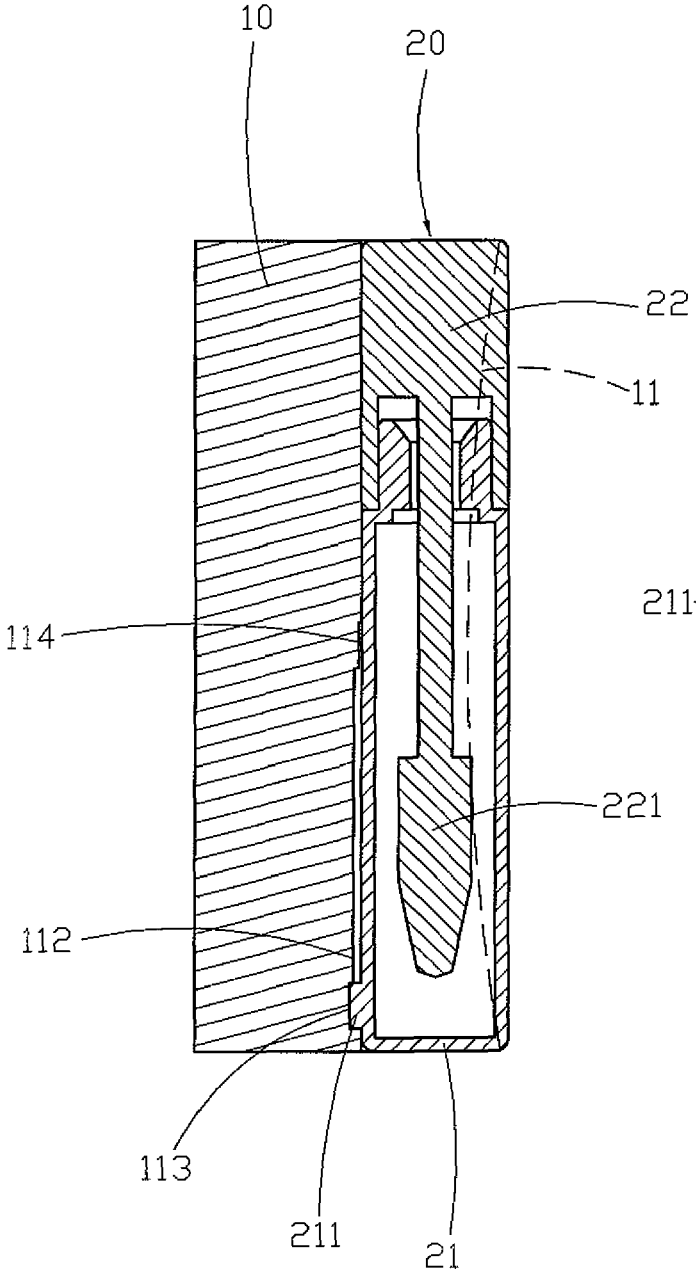
FIG. 3 is a front cross-sectional view of the cosmetic box as shown in FIG. 1.
Figure 4:
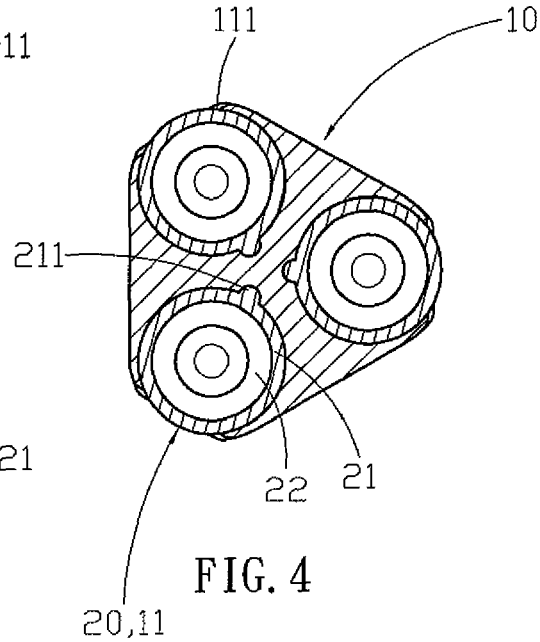
FIG. 4 is a top cross-sectional view of the cosmetic box as shown in FIG. 3.

In operation, referring to FIGS. 3-8 with reference to FIGS. 1 and 2, the lid 22 of each of the cosmetic items 20 is fully hidden in the opening 111 of the respective receiving chamber 11 of the main body 10 when the positioning protrusion 211 of each of the cosmetic items 20 is locked in the positioning groove 113 of the respective receiving chamber 11 of the main body 10 as shown in FIGS. 3 and 4, so that each of the cosmetic items 20 is fully hidden in the respective receiving chamber 11 of the main body 10 when not in use.

Figure 5:
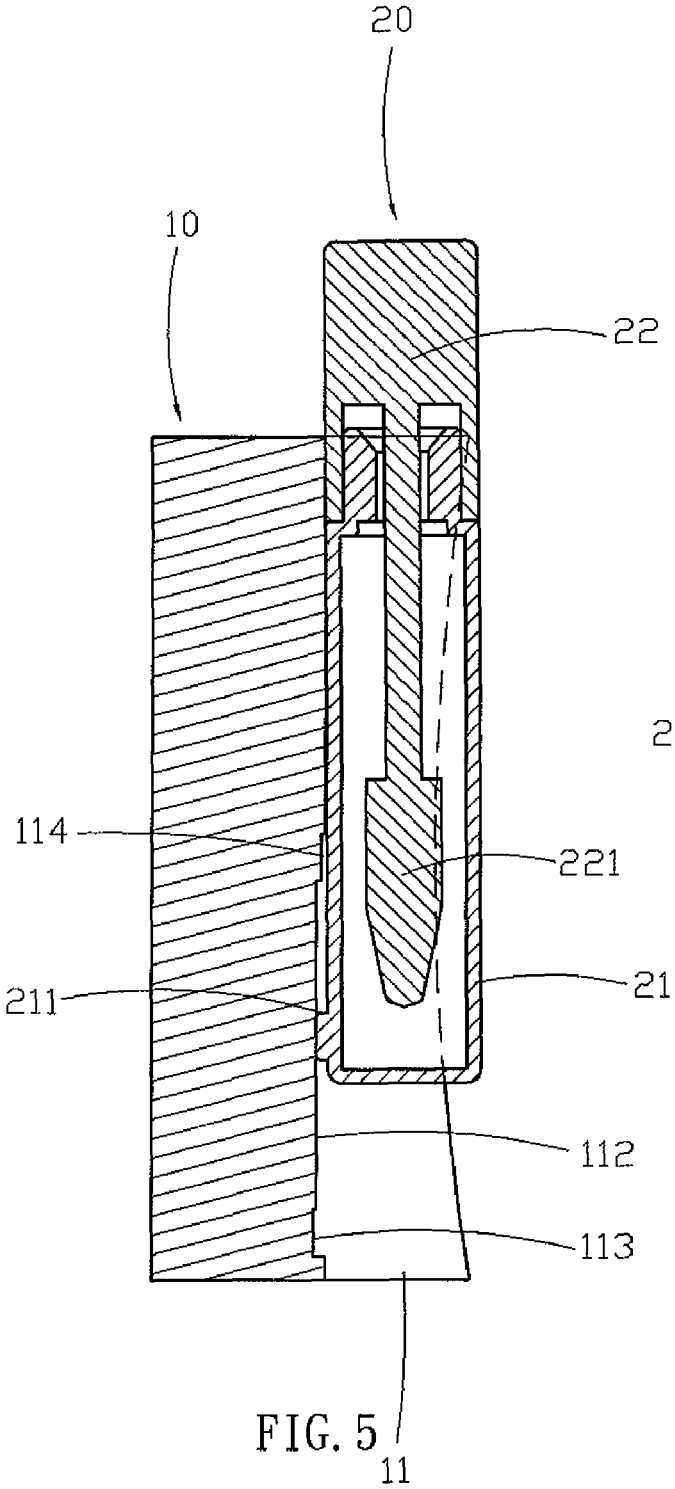
FIG. 5 is a schematic operational view of the cosmetic box as shown in FIG. 3.
Figure 6:
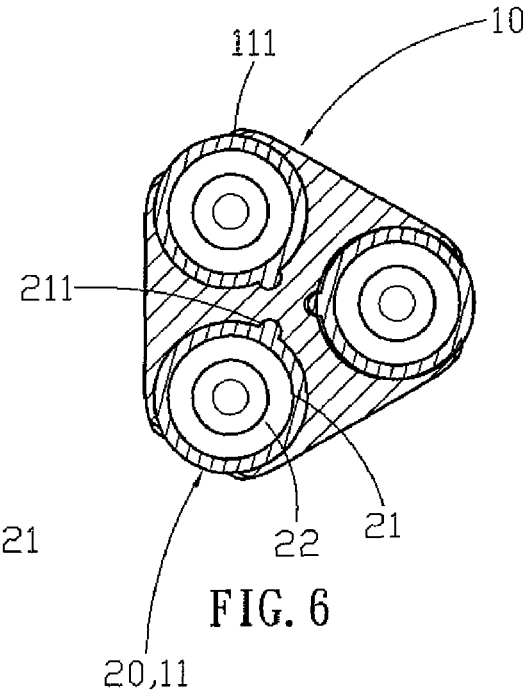
FIG. 6 is a top cross-sectional view of the cosmetic box as shown in FIG. 5.

When the positioning protrusion 211 of each of the cosmetic items 20 is detached from the positioning groove 113 of the respective receiving chamber 11 of the main body 10, the positioning protrusion 211 of each of the cosmetic items 20 is movable in the guide slot 112 of the respective receiving chamber 11 of the main body 10 as shown in FIGS. 5 and 6, so that each of the cosmetic items 20 is movable outwardly relative to the main body 10 to expose the lid 22 of each of the cosmetic items 20 from the opening 111 of the respective receiving chamber 11 of the main body 10.

When the positioning protrusion 211 of each of the cosmetic items 20 is movable to abut the limit portion 114 of the guide slot 112 of the respective receiving chamber 11 of the main body 10 as shown in FIGS. 7 and 8, the lid 22 of each of the cosmetic items 20 fully protrudes outwardly from the opening 111 of the respective receiving chamber 11 of the main body 10, while the container 21 of each of the cosmetic items 20 is locked in and non-rotatable relative to the respective receiving chamber 11 of the main body 10, so that the lid 22 of each of the cosmetic items 20 is rotatable relative to and detachable from the container 21 to remove the brush 221 from the container 21 for use with a user.

Accordingly, the main body 10 is provided with a plurality of receiving chambers 11 to receive a plurality of cosmetic items 20 so that cosmetic box is used to store multiple cosmetic items 20 to facilitate a user's makeup purposes. In addition, when each of the cosmetic items 20 protrudes outwardly from the main body 10, the container 21 of each of the cosmetic items 20 is locked in and non-rotatable relative to the respective receiving chamber 11 of the main body 10, so that the lid 22 of each of the cosmetic items 20 is rotatable relative to and detachable from the container 21 to remove the brush 221 from the container 21, thereby facilitating the user operating the brush 221 of each of the cosmetic items 20. Further, each of the cosmetic items 20 is snapped into and locked in the respective receiving chamber 11 of the main body 10 when not in use, so that each of the cosmetic items 20 is protected by the main body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A cosmetic box, comprising:

a main body having a periphery provided with a plurality of receiving chambers;

a plurality of cosmetic items mounted in the receiving chambers of the main body respectively;

wherein each of the receiving chambers of the main body is defined by a substantially C-shaped flexible limit wall;

the limit wall of each of the receiving chambers of the main body has an outer edge having a substantially concave profile;

each of the receiving chambers of the main body has a first end provided with an opening and a second end provided with an arcuate positioning groove;

each of the receiving chambers of the main body has a peripheral wall provided with an elongate guide slot connected to the positioning groove;

each of the cosmetic items is provided with an arcuate positioning protrusion movable in the guide slot of the respective receiving chamber of the main body and detachably lockable in the positioning groove of the respective receiving chamber of the main body.

2. The cosmetic box in accordance with claim 1, wherein each of the cosmetic items is movable in and non-rotatable relative to the respective receiving chamber of the main body;

each of the cosmetic items has a length flush with that of the respective receiving chamber of the main body;

each of the cosmetic items is fully received in the respective receiving chamber of the main body at a normal state.

3. The cosmetic box in accordance with claim 1, wherein the guide slot of each of the receiving chambers of the main body extends in a longitudinal direction of the main body;

the positioning protrusion of each of the cosmetic items is locked in the positioning groove of the respective receiving chamber of the main body when each of the cosmetic items is fully received in the respective receiving chamber of the main body.

4. The cosmetic box in accordance with claim 1, wherein the guide slot of each of the receiving chambers of the main body has a first end connected to the positioning groove and a second end provided with a protruding limit portion located between the opening and the positioning groove.

5. The cosmetic box in accordance with claim 4, wherein each of the cosmetic items includes a container and a lid removably mounted on and rotatable relative to the container;

the container of each of the cosmetic items has a periphery provided with the positioning protrusion.

6. The cosmetic box in accordance with claim 5, wherein the lid of each of the cosmetic items is located in the first end of the respective receiving chamber of the main body;

the container of each of the cosmetic items is located in the second end of the respective receiving chamber of the main body.

7. The cosmetic box in accordance with claim 5, wherein the lid of each of the cosmetic items is provided with a brush inserted into the container.

8. The cosmetic box in accordance with claim 5, wherein the lid of each of the cosmetic items fully protrudes outwardly from the opening of the respective receiving chamber of the main body when the positioning protrusion of each of the cosmetic items is movable to abut the limit portion of the guide slot of the respective receiving chamber of the main body.

9. The cosmetic box in accordance with claim 5, wherein the container of each of the cosmetic items partially protrudes outwardly from the opening of the respective receiving chamber of the main body when the positioning protrusion of each of the cosmetic items is movable to abut the limit portion of the guide slot of the respective receiving chamber of the main body.

10. The cosmetic box in accordance with claim 9, wherein the container of each of the cosmetic items is locked in and non-rotatable relative to the respective receiving chamber of the main body when the positioning protrusion of each of the cosmetic items is limited in the limit portion of the guide slot of the respective receiving chamber of the main body.

11. The cosmetic box in accordance with claim 1, wherein each of the receiving chambers of the main body extends in a longitudinal direction of the main body and extends through a whole length of the main body;

each of the receiving chambers of the main body has a length flush with that of the main body.

12. The cosmetic box in accordance with claim 1, wherein the limit wall of each of the receiving chambers of the main body surrounds the respective cosmetic item to clamp the respective cosmetic item in an elastic manner.

* * * * *